US005109588A

United States Patent [19]

Hewlett et al.

[11] Patent Number: 5,109,588

[45] Date of Patent: May 5, 1992

[54] COOLING WRAP METHOD OF MANUFACTURE

[76] Inventors: Kenneth M. Hewlett, 702 - 17½ St. SE.; Gary A. Nordine, 1003 - 1st Ave. SE., both of Rochester, Minn. 55904

[21] Appl. No.: 546,534

[22] Filed: Jun. 29, 1990

[51] Int. Cl.[5] ..... B23P 11/02

[52] U.S. Cl. ..... 29/525.1; 29/428; 220/903

[58] Field of Search ..... 220/903; 29/428, 525.1

[56] References Cited

U.S. PATENT DOCUMENTS

| | | | |
|---|---|---|---|
| 4,282,279 | 8/1981 | Strickland | 220/903 X |
| 4,293,015 | 10/1981 | McGough | 220/903 X |
| 4,401,245 | 8/1983 | Zills | 220/903 X |
| 4,514,995 | 5/1985 | Curtis et al. | 220/903 X |
| 4,540,611 | 9/1985 | Henderson | 220/903 X |

*Primary Examiner*—Timothy V. Eley
*Attorney, Agent, or Firm*—Lawrence M. Nawrocki

[57] ABSTRACT

An improved multi-layer wrap for keeping a beverage container cool is made by first forming a jacket assembly having inner and outer pockets. An insulating blanket is inserted into the outer pocket of the jacket assembly through an entrance opening thereto. A first part of a hook and pile fastener is then secured to the outer pocket covering the entrance opening to completely and permanently enclose the insulating blanket in the outer pocket. The other part of the fastener is secured to the other end of the jacket assembly on the other face to allow the ends to be connected together after the wrap is placed around the container. The inner pocket has an open end for removably receiving a blanket containing a heat absorbing material.

14 Claims, 2 Drawing Sheets

COOLING WRAP METHOD OF MANUFACTURE

TECHNICAL FIELD

The present invention relates to a wrap used around an individual beverage container, such as a can, for keeping the beverage cool. More particularly, this invention relates to a multi-layer wrap having a heat absorbing layer and a heat insulating layer, and to an improved method of manufacturing such a wrap.

BACKGROUND OF THE INVENTION

Flexible wraps are known for use around individual beverage containers, such as cans or cups, for keeping the beverages cool. These wraps typically have some type of heat absorbing material which extracts heat from the beverage. This material is usually pre-cooled to be able to absorb a substantial amount of heat. In addition, the heat absorbing material is often protected by a layer of insulating material. One such prior device, known as the Ice Wrap, is manufactured by the Cordy Corporation, the assignee of the present invention.

U.S. Pat. No. 4,399,668 to Williamson discloses another example of a beverage cooler of this general type. In one embodiment, the cooler includes a pocket for receiving a coolant layer that has been pre-cooled in a refrigeration device. An insulation layer is located adjacent the coolant layer. Fasteners on the ends of the device are used to secure the ends together after the device has been wrapped around a beverage container. The fasteners may include Velcro strips.

One problem in manufacturing these prior wraps, including that shown in the Williamson patent, is the difficulty in aligning the multiple layers thereof and securing them together. For example, the insulating layer comprises a relatively thick blanket of insulative fabric. This blanket has to be faced with the material forming the pocket for the coolant layer. Then, this assemblage has to be put into a sewing machine and sewed together. This can be relatively difficult to do, given the thickness of the materials and the need to keep them aligned while the assemblage is turned in the sewing machine during the sewing operation.

SUMMARY OF THE INVENTION

One aspect of this invention is to provide an improved method of manufacturing a flexible, multi-layer wrap for keeping a beverage container cool, and to the wrap made in accordance with the method.

Accordingly, the method of this invention comprises providing a jacket assembly having pockets formed on opposed inner and outer faces thereof, each pocket having an entrance opening thereto. A first blanket made of a heat absorbing material is further provided to be insertable into the inner pocket of the jacket assembly. The entrance opening to the inner pocket is left open so that the first blanket is removably insertable into the inner pocket during use of the wrap after the first blanket has been cooled. A second blanket made of an insulating material is further provided for insertion into the outer pocket of the jacket assembly. After the second blanket is so inserted into the outer pocket through the entrance opening thereto, the entrance opening to the outer pocket is closed to completely enclose the second blanket within the outer pocket. Finally, the method also comprises attaching fastening means to opposite ends of the jacket assembly so that the ends of the jacket assembly may be secured together after the jacket assembly has been wrapped around a beverage container with the inner pocket adjacent the beverage container and the outer pocket surrounding the inner pocket.

BRIEF DESCRIPTION OF THE DRAWINGS

The present invention will be described in more detail in the following Detailed Description, when taken in conjunction with the following drawings, in which like reference numerals refer to like elements throughout.

DETAILED DESCRIPTION

Figure 1:
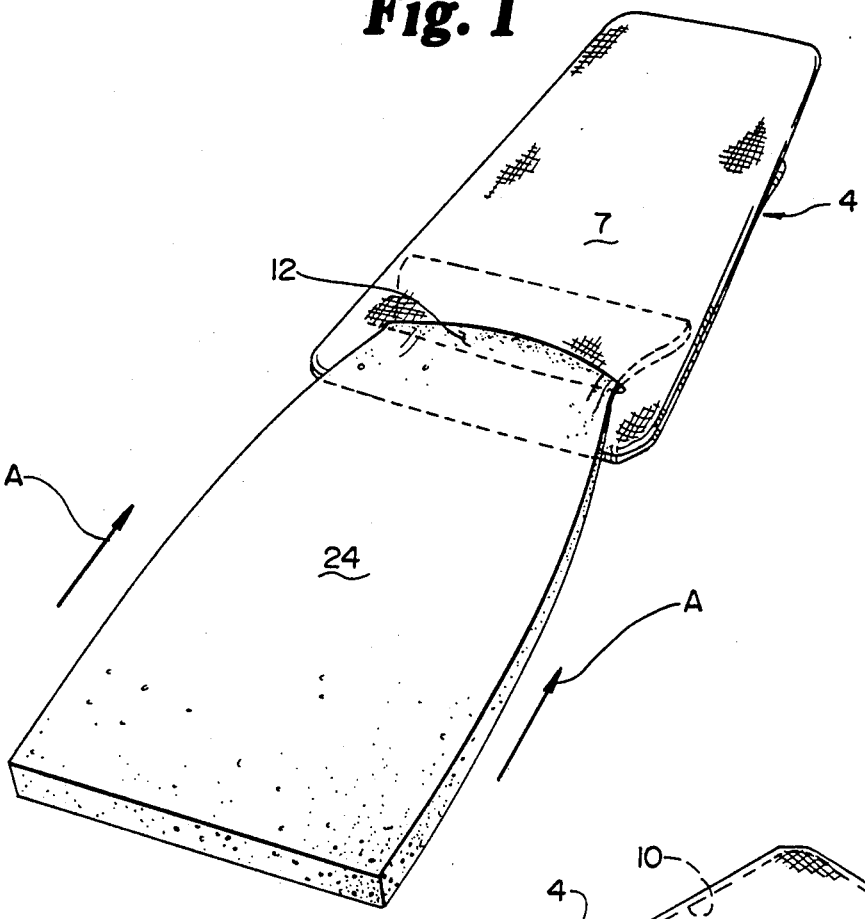
FIG. 1 is a perspective view of one of the steps of the manufacture of an improved multi-layer wrap according to this invention, particularly illustrating the step of inserting the insulating blanket into the outer pocket in the pre-formed jacket assembly.
Figure 2:
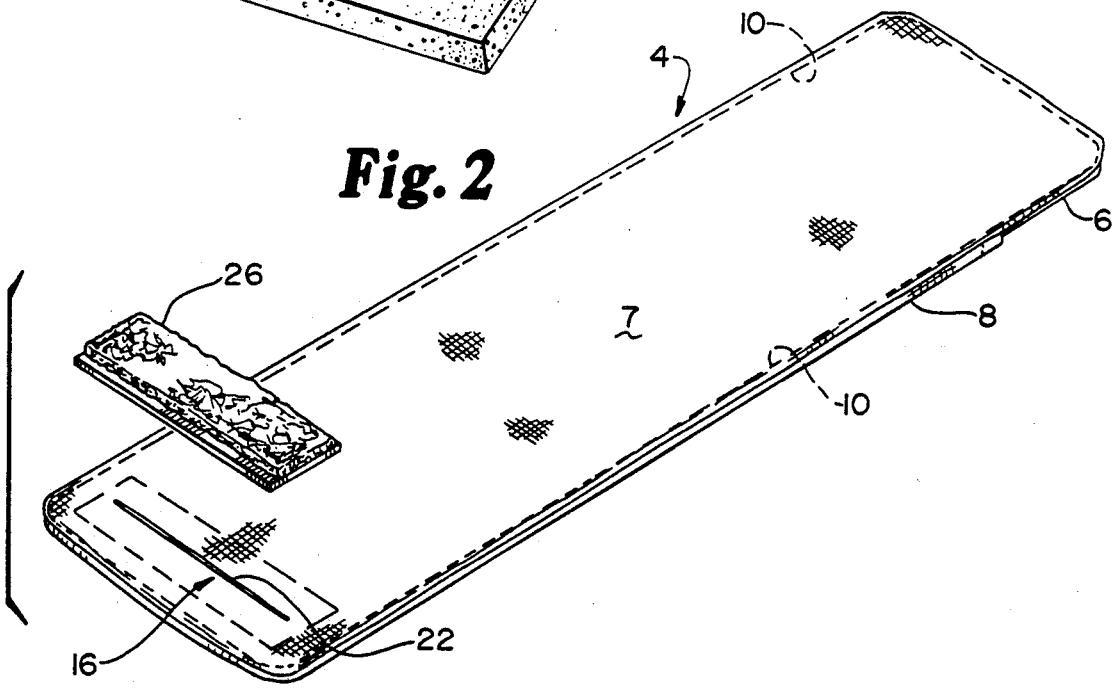
FIG. 2 is a perspective view of another of the steps of the manufacture of an improved multi-layer wrap according to this invention, particularly illustrating the step of attaching a strip of fastening material across the slit in the outer pocket to enclose the insulating blanket in the outer pocket of the jacket assembly.

A wrap according to the present invention is illustrated generally as 2 in the drawings. Wrap 2 includes a jacket assembly 4 having a rectangular central layer 6. The outer face of jacket assembly 4 is formed by an outer layer 7 of generally the same size as central layer 6 abutted against one face of central layer 6. Inner layer 8 is generally the same width as central layer 6 but is slightly shorter than central layer 6. All of the layers 6–8 are made of suitable durable, long-lasting fabric, e.g. rayon, nylon, etc.

Layers 6–8 are secured together in a first step to form a pre-formed jacket assembly 4. In this regard, the layers 6–8 are superimposed over one another with the peripheral edges joined together by stitching 10. When this has been done, jacket assembly 4 includes inner and outer pockets 11 and 12, respectively, on opposite faces thereof. Inner pocket 11 is formed by the space between inner layer 8 and central layer 6. Outer pocket 12 is formed by the space between outer layer 7 and central layer 6.

The words "inner" and "outer", when applied to layers 7 and 8 and the pockets formed thereby, refer to the inner and outer sides of wrap 2 when wrap 2 is placed around a beverage container 14. Inner pocket 11 is the pocket which is on the interior of wrap 2 in direct contact with container 14. Outer pocket 12 is the exterior pocket on wrap 2, i.e. the pocket which forms the exterior face of wrap 2 and surrounds inner pocket 11.

Figure 3:
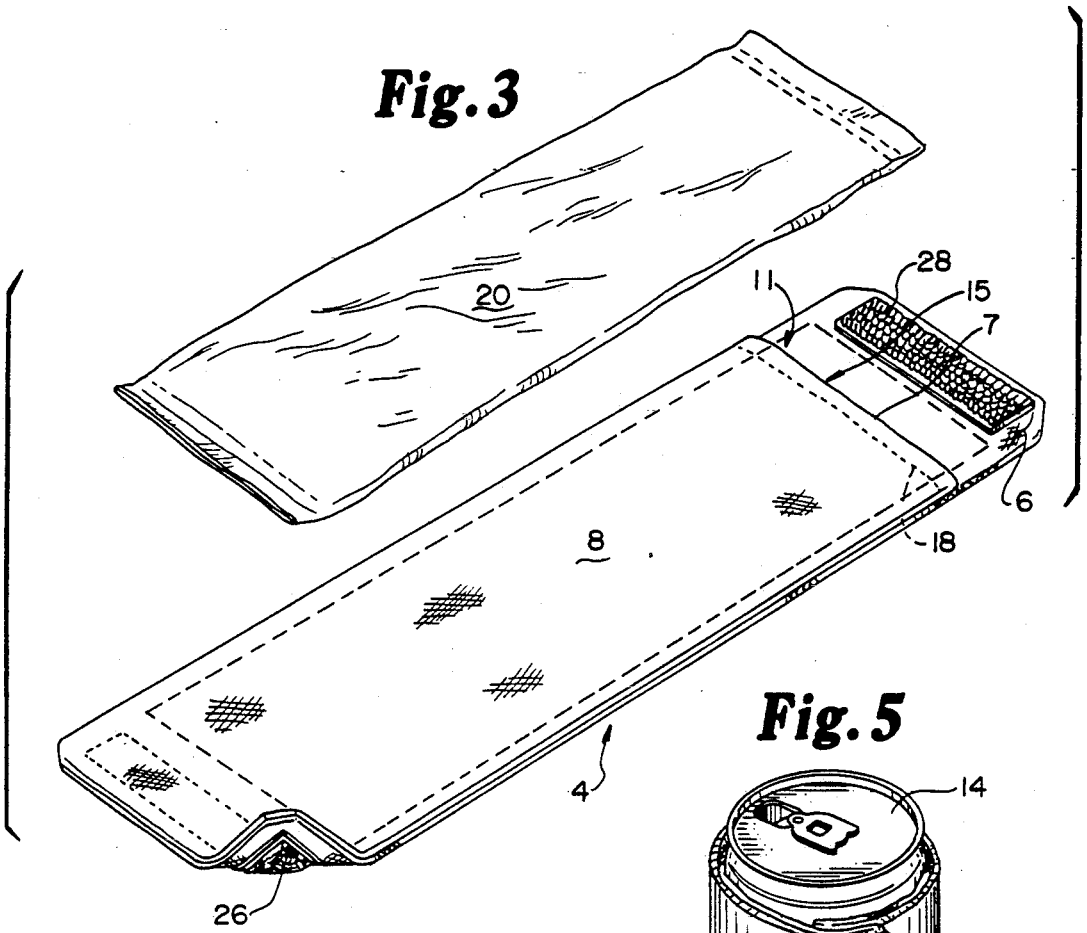
FIG. 3 is a perspective view of the wrap according to the present invention, showing the completed jacket assembly with the pocket into which the thermal, heat absorbing blanket is inserted during use of the wrap, the thermal blanket being shown separately from the wrap.
Figure 5:
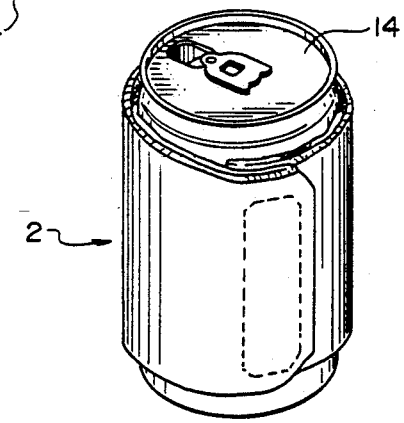
FIG. 5 is a perspective view of the wrap in place around a beverage container.
Figure 4:
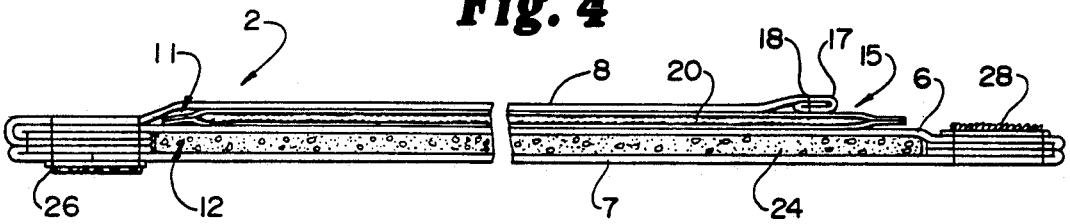
FIG. 4 is a cross-sectional view of the wrap according to the present invention, showing the thermal blanket inserted into its respective inner pocket and the insulating blanket permanently received in its respective outer pocket.

Entrance openings 15 and 16 are provided into inner and outer pockets 11–12, respectively. Entrance opening 15 into inner pocket 11 is formed by virtue of the fact that inner layer 8 is shorter than central layer 6 so that one side 17 thereof is spaced inwardly from the end of central layer 6. See FIG. 3. Side 17 is simply not stitched to central layer 6 so that side 17 is open to form entrance opening 15. A line of stitching 18 is provided on side 17, to form a pocket hem, but this stitching 18 does not onto extend down to central layer 6. Thus, inner pocket 11 has an open transverse end and comprises a longitudinally extending pocket for receiving a heat absorbing blanket 20 as described hereafter.

Entrance opening 16 to outer pocket 12 is formed by transversely cutting outer pocket 12 to provide a transverse slit 22 adjacent an opposite end of pocket 12, i.e. at an end of wrap 2 opposite to the end having entrance opening 15 to inner pocket 11. Slit 22 extends across most of the width of outer layer 7. However, the length of slit 22 is somwhat less than the width of a blanket 24 of flexible insulation material which is to be placed in outer pocket 12.

In manufacturing a wrap 2 according to this invention, the first step is to form or provide a pre-formed jacket assembly 4 as just described, i.e. having inner and outer pockets 11–12 as set forth above. Thin, insulation blanket 24, which may be of any suitable material resistant to the transmission of heat, e.g. foam, etc., is slipped into outer pocket 12 through slit 22. Blanket 24 is sized to fill approximately all of the interior space of outer pocket 12. In addition, blanket 24 is made of a compressible material to allow the blanket to be compressed as it is inserted into slit 22. Blanket 24 is then pushed in the direction illustrated by the arrow A in FIG. 1 until it clears slit 22, after which blanket 24 will expand to substantially fill outer pocket 12. The expansion of blanket 24, which occurs naturally after the constriction formed by slit 22 is past, will conveniently keep blanket 24 retained in pocket 12 since it is now too big to fall back out of slit 72.

After insulation blanket 24 is installed in this manner, the next step is to provide suitable fastening means on opposed ends of wrap 2 on opposite faces thereof. Preferably, the fastening means comprises first and second strips 26 and 28 of Velcro material, i.e. a hook and pile fastener. Thus, first strip 26 comprises a strip of Velcro hook material. Desirably, strips 26 and 28 are simply sewn in a transverse direction to the opposed faces of jacket assembly 4 as indicated by stitiching 30. However, any other suitable fastening means or attachment methods could be used in place of Velcro strips 26 and 28 and stitching 30.

One of the fastening strips, i.e. Velcro pile strip 26 is sewn to outer layer 7 across slit 22 defining entrance opening 16 to outer pocket 12. Thus, fastening strip 26 effectively closes the entrance opening to outer pocket 12 after insulation blanket 24 is inserted therein for permanently retaining insulation blanket 24 in outer pocket 12 during use over the normal life of wrap 2. The other fastening strip, i.e. Velcro hook strip 28, is sewn to the opposite end of central layer 6 above entrance opening 15 to inner pocket 11. See FIG. 3.

Once the fastening means has been attached to jacket assembly 4 as just described, wrap 2 may be used in conjunction with heat absorbing blanket 20. Blanket 20 is made of a suitable covering or shell which encloses a suitable heat absorbing material. The heat absorbing material may have any of numerous suitable forms. One preferred form is to use a material which does not freeze solid even when chilled. Thus, heat absorbing blanket 20 will be flexible even when it is chilled to allow wrap 2 to be wrapped around container 14.

As mentioned above, the preferred form of the heat absorbing material held within blanket 20 is one which does not freeze solid even when chilled. Some of such materials have the disadvantages of needing to be placed in a chilling compartment to have heat withdrawn therefrom, and being manipulated in a state which is cold to the touch. This disadvantage can be overcome by providing a blanket 20 which encloses a multiplicity of ammonium nitrate pellets and a packet of water. The packet is constructed so that, upon the application of pressure, it will rupture and the water will intermix with the ammonium nitrate pellets. Such mixing will effect an endothermic reaction wherein heat will be absorbed. Such a structure, thereby, will not be cold to the touch prior to the rupturing of the water packet.

Alternatively, it would be possible to use in blanket 20 a heat absorbing material which does freeze solid when chilled. In such a case, however, the covering for the heat absorbing blanket would be formed with a plurality of transverse compartments in which the heat absorbing material is contained. These compartments would be separated by transversely extending score lines. These score lines are necessary to allow wrap 2 to be bent around container 14.

As can be appreciated, heat absorbing blanket 20 is not permanently held in inner pocket 11, but is releasable therefrom. Blanket 20 is taken out of pocket 11 and placed in a refrigerator or freezer prior to use to chill the heat absorbing material. Immediately before wrap 2 is to be used, blanket 20 is removed from the refrigeration device and inserted into inner pocket 11. Wrap 2 is then simply wrapped around beverage container 14 with inner pocket 11 being immediately adjacent container 14 and outer pocket 12 surrounding inner pocket 11. The ends of wrap 2 are secured together by pressing the releasable hook and pile fastener strips 26 and 28 together.

After wrap 2 is installed, and beverage container 12 starts to absorb ambient heat from the environment, that heat is transferred into heat absorbing blanket 20, causing the blanket to gradually warm up and lose its stored coldness. In other words, the cold temperature stored in heat absorbing blanket 20 is traded off for any heat accumulating in container 12 tending to heat the beverage. The use of insulating blanket 24 also helps slow down the rate at which heat is transferred into the heat absorbing blanket 20 from the environment. The net effect of the operation of wrap 2 is that the beverage in container 14 stays cooler than it would otherwise. This is a desirable advantage for keeping drinks cool on a hot summer's day.

Wrap 2 according to this invention is easier to manufacture than prior art wraps of this type. It is much easier to sew the layers 6–8 forming jacket assembly 4 together when insulation blanket 24 is not sandwiched therein. Then, it is relatively easy to simply slip insulation blanket 24 into outer pocket 12 formed to receive it. The use of one of the fastening strips 26 or 28 positioned on top of slit 22 is a convenient and inexpensive way of closing the entrance to outer pocket 12 and permanently uniting insulation blanket 24 to jacket assembly 4.

Various modifications of this invention will be apparent to those skilled in the art. Accordingly, the scope of this invention is to be limited only by the appended claims.

What is claimed is:

1. An improved method of manufacturing a flexible, multi-layer wrap suited for being wrapped around a beverage container for helping keep the beverage cool, which comprises:

(a) providing a jacket assembly having pockets formed on opposed inner and outer faces thereof, each pocket having an entrance opening thereto;

(b) providing a first blanket made of a heat absorbing material which when cooled is capable of absorbing heat from the beverage, wherein the first blanket is insertable into the inner pocket of the jacket assembly;

(c) leaving the entrance opening to the inner pocket open so that the first blanket is removably insertable into the inner pocket during use of the wrap after the first blanket has been cooled;

(d) providing a second blanket made of an insulating material for slowing the transmission of ambient heat to the first blanket, wherein the second blanket is insertable into the outer pocket of the jacket assembly;

(e) inserting the second blanket into the outer pocket through the entrance opening to the outer pocket;

(f) closing the entrance opening to the outer pocket to completely enclose the second blanket within the outer pocket; and (g) attaching fastening means to opposite ends of the jacket assembly so that the ends of the jacket assembly may be secured together after the jacket assembly has been wrapped around a beverage container with the inner pocket adjacent the beverage container and the outer pocket surrounding the inner pocket.

2. An improved method as recited in claim 1, wherein the jacket assembly is generally rectangular, and wherein the entrance opening to the outer pocket extends transversely across the width of the jacket assembly adjacent one end thereof.

3. An improved method as recited in claim 2, wherein the step of closing the entrance opening to the outer pocket comprises the step of attaching a portion of the fastening means to the outer pocket over the entrance opening thereto.

4. An improved method as recited in claim 1, wherein the fastening means comprises first and second fastening strips which together form a hook and pile fastener, wherein the step of attaching the fastening means comprises:

(a) securing one of the fastening strips adjacent one end of one face of the jacket assembly; and (b) securing the outer fastening strip to the opposed end of the outer face of the jacket assembly over the entrance opening to the outer pocket to simultaneously attach that strip and close the entrance opening to the outer pocket.

5. An improved method as recited in claim 4, wherein the fastening strips are sewn to the jacket assembly.

6. An improved method as recited in claim 1, wherein the step of providing the jacket assembly comprises:

(a) providing generally rectangular inner, central and outer layers;

(b) abutting the inner and outer layers against opposed faces of the central layer;

(c) securing the inner and outer layers to the central layer so that the inner and outer pockets are defined by the space between the inner layer and the central layer and the space between the outer layer and the central layer, respectively; and (d) providing entrance openings through the inner and outer layers to have access to the inner and outer pockets, respectively.

7. An improved method as recited in claim 6, wherein all the layers are made of fabric.

8. An improved method as recited in claim 6, wherein the inner layer is not as long as the central layer but has approximately the same width as the central layer, wherein the inner layer is secured to the central layer along only three peripheral edges thereof with an open fourth edge thereof forming the entrance opening through the inner layer.

9. An improved method as recited in claim 6, wherein the outer layer is approximately the same size as the central layer and when abutted thereto substantially overlies the central layer, wherein the outer layer is secured to the central layer along its four peripheral edges, and wherein the entrance opening in the outer layer is provided by slitting the outer layer with the slit being of sufficient size to allow the second blanket to pass therethrough.

10. An improved method as recited in claim 9, wherein the slit extends transversely across one end of the outer layer so that the entrance opening through the outer layer is adjacent one end of the second pocket.

11. An improved method as recited in claim 10, wherein the second blanket is made of a compressible material and is slightly wider than the length of the slit, whereby the second blanket may be compressed when passing through the slit and will expand after being received in the outer pocket to prevent the second blanket from passing back through the slit.

12. An improved method as recited in claim 9, wherein the step of closing the entrance opening to the outer pocket comprises the step of attaching a portion of the fastening means to the outer layer covering the slit.

13. An improved method as recited in claim 12, wherein the attaching step comprises sewing one portion of a hook and pile fastener to the outer layer.

14. An improved flexible, multi-layer wrap suited for being wrapped around a beverage container for helping keep the beverage cool made in accordance with the method set forth in claim 1.

* * * * *